US006409612B1

(12) United States Patent
Evans et al.

(10) Patent No.: US 6,409,612 B1
(45) Date of Patent: Jun. 25, 2002

(54) WEIGHTING MEMBER FOR A GOLF CLUB HEAD

(75) Inventors: D. Clayton Evans, San Marcos; Donald A. Bistline, Vista; Victor S. Dennis, Rancho Santa Fe, all of CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/578,788

(22) Filed: May 23, 2000

(51) Int. Cl.[7] ..... A63B 53/04; A63B 53/06; A63B 53/08

(52) U.S. Cl. ..... 473/324; 473/334; 473/349

(58) Field of Search ..... 473/334, 333, 473/335, 341, 349, 350

(56) References Cited

U.S. PATENT DOCUMENTS

| | | | | |
|---|---|---|---|---|
| 3,995,857 A | | 12/1976 | Cochran et al. | |
| 4,071,354 A | | 1/1978 | Mocarski | |
| 4,092,223 A | | 5/1978 | Kaufman | |
| 4,382,818 A | | 5/1983 | Mocarski | |
| 4,591,481 A | | 5/1986 | Lueth | |
| 4,883,274 A | * | 11/1989 | Hsien | 273/164 |
| 4,931,241 A | | 6/1990 | Freitag | |
| 5,000,779 A | | 3/1991 | German et al. | |
| 5,098,469 A | | 3/1992 | Rezhets | |
| 5,282,625 A | | 2/1994 | Schmidt et al. | |
| 5,441,553 A | | 8/1995 | Polizzotti et al. | |
| 5,447,309 A | | 9/1995 | Vincent | |
| 5,518,243 A | * | 5/1996 | Redman | 473/334 |
| 5,776,010 A | | 7/1998 | Helmstetter et al. | |
| 5,863,492 A | | 1/1999 | Bose | |
| 6,027,010 A | | 2/2000 | Shira | |
| 6,030,294 A | | 2/2000 | Shira | |

FOREIGN PATENT DOCUMENTS

GB 2 332 149 6/1999

* cited by examiner

*Primary Examiner*—Paul T. Sewell
*Assistant Examiner*—Sneh Varma
(74) *Attorney, Agent, or Firm*—Michael A. Catania

(57) ABSTRACT

A weighting device for a golf club head is disclosed herein. The weighting device has a polymer body with a plurality of ports for holding a plurality of high density members. The high density members are preferably tungsten spheres. The weight of the weighting device may be adjusted by increasing or decreasing the number of high density members. The weighting device is preferably removable from a golf club head to allow for adjustment in the golf club head's center of gravity, moment of inertia and swingweight.

9 Claims, 6 Drawing Sheets

WEIGHTING MEMBER FOR A GOLF CLUB HEAD

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention generally relates to a golf club heads. Specifically, the present invention relates to a weighting member for a golf ball club head.

2. Description of the Related Art

Numerous techniques have been used for weighting golf club heads in order to gain better performance. In persimmon wood club heads, weights were attached to the sole in order to lower the center of gravity. The first metal woods had sufficient weight, however, the weight distribution deterred slightly from performance. The refinement of hollow metal woods with weighting on the sole improved upon the performance of these clubs. An example of such woods are the GREAT BIG BERTHA® HAWK EYE® drivers and fairway woods, developed by the Callaway Golf Company of Carlsbad, Calif., that use a tungsten screw in the sole of each titanium club head body. Another example of additional weighting of a golf club head is set forth in U.S. Pat. No. 5,447,309, which discloses the use of three weights fixedly disposed within the interior of a club head to provide a selected moment of inertia for the club head. Yet another example is set forth in British Patent Application Number 2332149 for a Golf Club Head With Back Weighting Member, which discloses a weight pocket in the exterior rear of a wood for placement of epoxy inserts that vary in density.

In irons, weighting of the club head has assumed many variations. One example is perimeter weighting in which the mass is shifted to the perimeter of the club head such as the BIG BERTHA® X-12® irons developed by the Callaway Golf Company and as set forth in U.S. Pat. No. 5,282,625. An example of additional weighting is set forth in U.S. Pat. No. 3,995,857 which discloses the placement of tungsten inserts into the rear of an iron. Another example of additional weighting is the GREAT BIG BERTHA® TUNGSTEN-TITANIUM™ irons, developed by the Callaway Golf Company, which used a screw to attach a tungsten block to the rear and sole of an stainless steel iron as set forth in U.S. Pat. No. 5,776,010. Yet another example is the GREAT BIG BERTHA® TUNGSTEN-INJECTED™ HAWK EYE® irons, also developed by the Callaway Golf Company, which feature an internal cavity with tungsten pellets in a solder, as set forth in co-pending U.S. patent application Ser. No. 09/330,292, for an Internal Cavity Tungsten Titanium Iron, filed on Jun. 11, 1999. The weighting of putters has varied as with woods and irons.

However, prior technology have been similar in that the weighting means, whether it is a medallion, plug, insert or the like, is a static weight and mass. More precisely, once positioned on the club head, the weight does not change. If a new weight is desired, then the old weight is removed and an entirely new weight means is placed on the golf club head. The weights may be ground to remove mass in order to lower the weight, however, these prior art weights cannot easily have their mass increased by the addition of material.

Further, each of the prior art weighting means have a fixed and unchangeable center of gravity ("CG") and fixed and unchangeable moments of inertia ("MOI"). The CG cannot be moved and the MOI cannot be increased or decreased without dimensionally changing the prior art weighting means. Thus, the golf industry needs a weighting mechanism that allows for greater flexibility to adjust, the CG, MOI and also the swingweight on a golf club.

BRIEF SUMMARY OF THE INVENTION

The present invention provides a solution to the problems of weighting in golf club heads that allows for greater flexibility in modifying the CG, MOI and swingweight of a golf club. The present invention is able to accomplish this by providing a weighting device composed of a polymer material, and which has a plurality of cavities for placement of high density pellets within some or all of the cavities. The weighting device is removably attached to the club head, and the number of pellets is increased or decreased to adjust the weight.

One aspect of the present invention is a weighting device for a golf club head. The weighting device includes a body and a plurality of high density members. The body is composed of a first material having a first density, and has a plurality of ports. The plurality of high density members are each disposed within a corresponding port of the plurality of ports. Each of the plurality of high density members is composed of a second material having a second density that is greater than the first density.

Another aspect of the present invention is a golf club head having a body and a weighting device disposed on the body. The body has a striking plate, a sole, a toe end and a heel end. The weighting device includes a weighting body and a plurality of high density members. The weighting body is composed of a first material having a first density, and it has a plurality of ports. The plurality of high density members are each disposed within a corresponding port of the plurality of ports. Each of the plurality of high density members is composed of a second material having a second density that is greater than the first density.

Yet another aspect of the present invention is a golf club head including a body and a weighting device. The body is composed of a metal material and has a striking plate, a sole, a toe end, a heel end and a hollow interior. The weighting device is disposed within the hollow interior of the body. The weighting device includes a weighting body and a plurality of tungsten spheres. The weighting body is composed of a polymer material having a density less than 1.0 grams per cubic centimeter, and it has a plurality of cavities. The plurality of tungsten spheres are each disposed within a corresponding cavity of the plurality of cavities.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
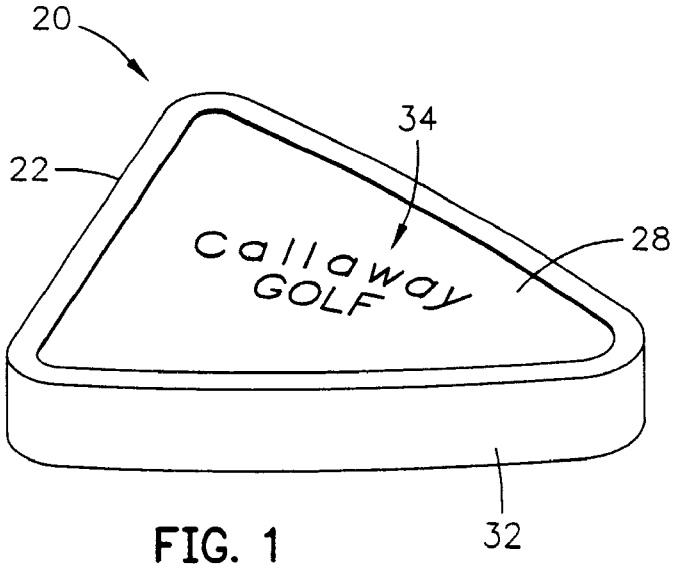
FIG. 1 is a top perspective view of a weighting device of the present invention.
Figure 2:
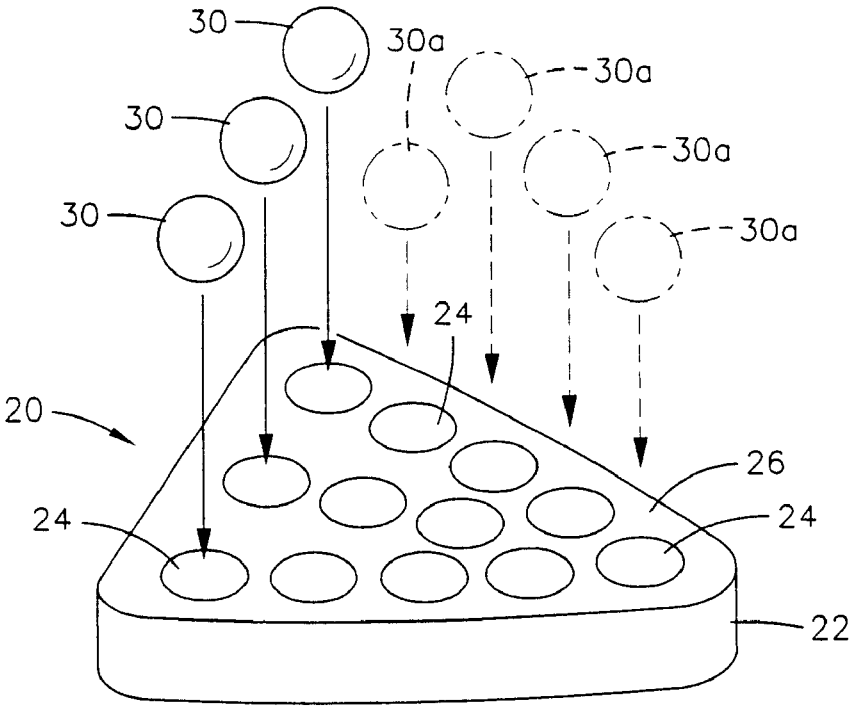
FIG. 2 is a bottom perspective exploded view of a weighting device of FIG. 1.

As shown in FIGS. 1 and 2, a weighting device of the present invention is generally designated 20. The weighting device 20 is generally composed of a polymer body 22 having a plurality of receiving ports 24 therein. The body may have an interior surface 26 and an exterior surface 28. A plurality of high density members 30 are placed within a corresponding receiving port of the plurality of receiving ports 24. The plurality of high density members 30 allow for the weight of the weighting device 20 to be modified depending on the number of high density members 30 placed within the receiving ports 24.

The polymer body 22 may be composed of any polymer material (thermoplastic and thermosetting) such as polyethylene, polyurethane, polyamides, polyetheramides, wax, rubbers, and the like. The material of the polymer body 22 preferably has a density in the range of 0.90 grams per cubic centimeters ("g/cc") to 1.00 g/cc. A preferred polymer material is polyurethane (thermoplastic or thermosetting) due to its durability.

Each of the plurality of receiving ports 24 is configured to receive a high density member 30. Further, each receiving port 24 may be a cavity having an interior surface, or be an aperture through the polymer body 22. Additionally, the shape and size of each of the receiving ports 24 may vary in a polymer body 22.

Each of the plurality of high density members 30 is configured to be disposed within a corresponding receiving port 24. The high density members 30 may be spheres, cylinders, cubes, pyramids, and any similar shape. A preferred embodiment of the high density members 30 is a spherical shape. The high density members 30 are composed of a high density material having a density greater than the density of a typical club head material, such as steel (density of 7.87 g/cc), or titanium (density of 4.51 g/cc). Preferably, the high density members 30 are composed of tungsten (density of 19.25 g/cc), copper (density of 8.93 g/cc), gold (density of 19.28 g/cc), silver (density of 10.50 g/cc), palladium (density of 12.00 g/cc), platinum (density of 21.47 g/cc), and the like. A preferred material for the high density members 30 is tungsten.

Referring again to FIGS. 1 and 2, the body 22 has a perimeter wall 32 that defines the thickness of the body 22. The thickness of the body 22 may vary, and preferably ranges from 0.25 inch to 1.00 inch. The thickness is determined by the placement of the weighting member 20 on a golf club head as further described below. The exterior surface 28 may have indicia 34, or a label attached thereto for aesthetic purposes. As shown in FIG. 2, the high density members 30 are placed within the receiving ports 24, and optional high density members 30*a* are shown in phantom lines to indicate the ability to adjust the weight of the weighting device 20. Thus, the high density members 30 may be positioned in the center of the body 22 or along the edge of the body 22 depending on the desired CG and MOI. Further, the number of high density members 30 may be increased or decreased to adjust the swingweight of the golf club.

Figure 3:
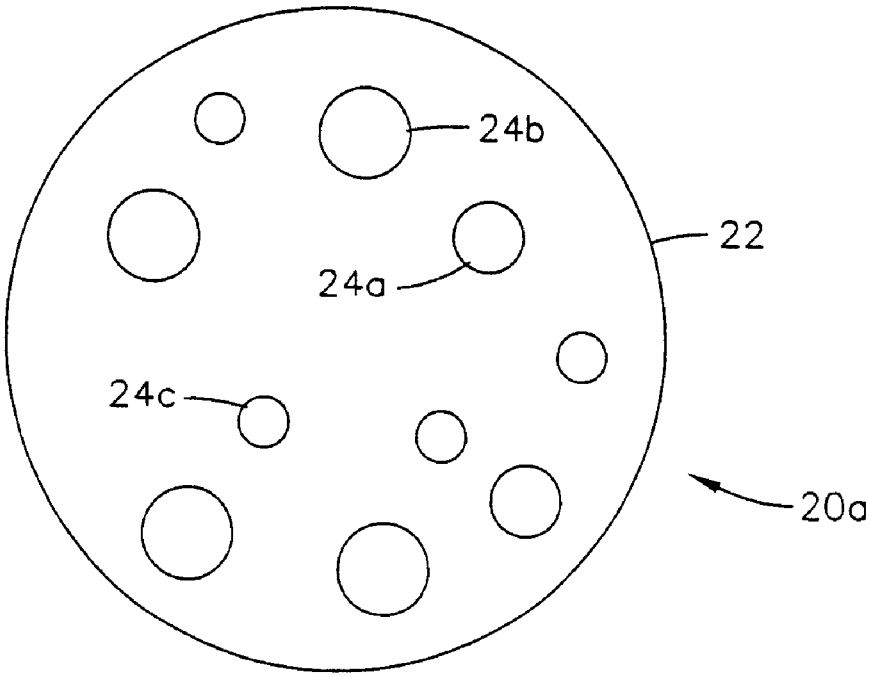
FIG. 3 is a top plan view of an alternative embodiment of a weighting device of the present invention.
Figure 4:
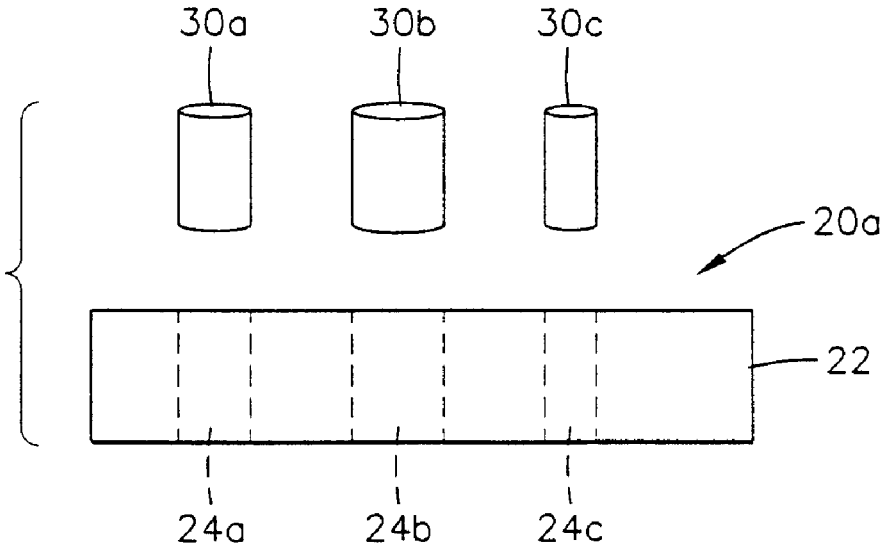
FIG. 4 is a side exploded view of the alternative embodiment weighting device of FIG. 3.

An alternative embodiment of the weighting device 20*a* is shown in FIGS. 3 and 4. In this embodiment, the body 22 is circular in shape and the receiving ports 24*a,* 24*b* and 24*c* are apertures of different diameter through the body 22. The high density members 30*a* 30*b* and 30*c* are cylindrical rods of varying shapes to match the varying diameters of the apertures 24. Those skilled in the pertinent art will recognize that variations of the shape and size of the body 22, the receiving ports 24 and the high density members 30 are within the scope and spirit of the present invention.

Figure 5:
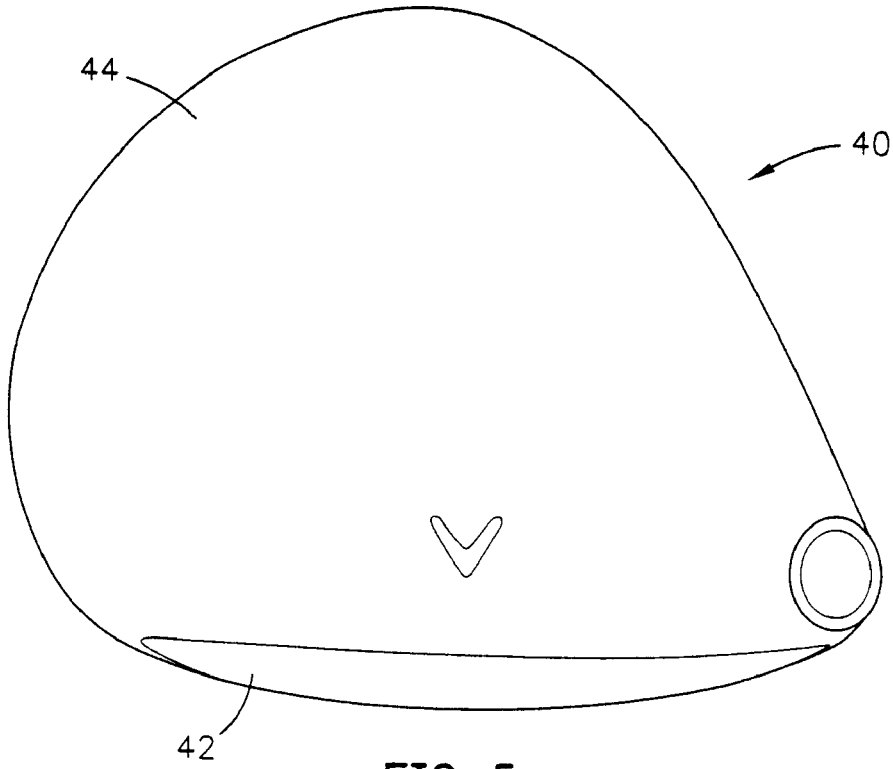
FIG. 5 is a top view of a wood golf club head incorporating the weighting device of the present invention.
Figure 6:
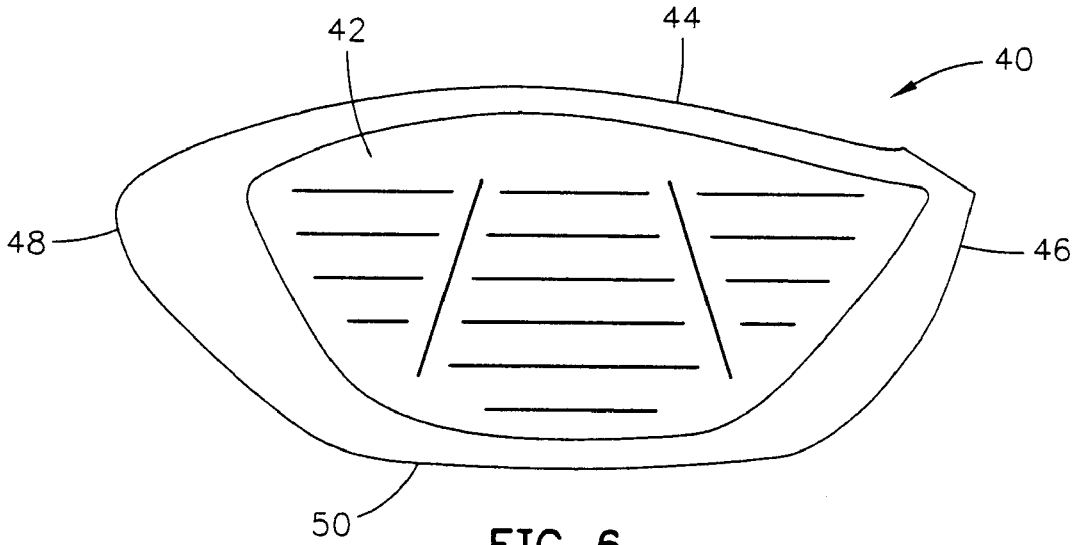
FIG. 6 is a front view of the wood golf club head of FIG. 5.
Figure 7:
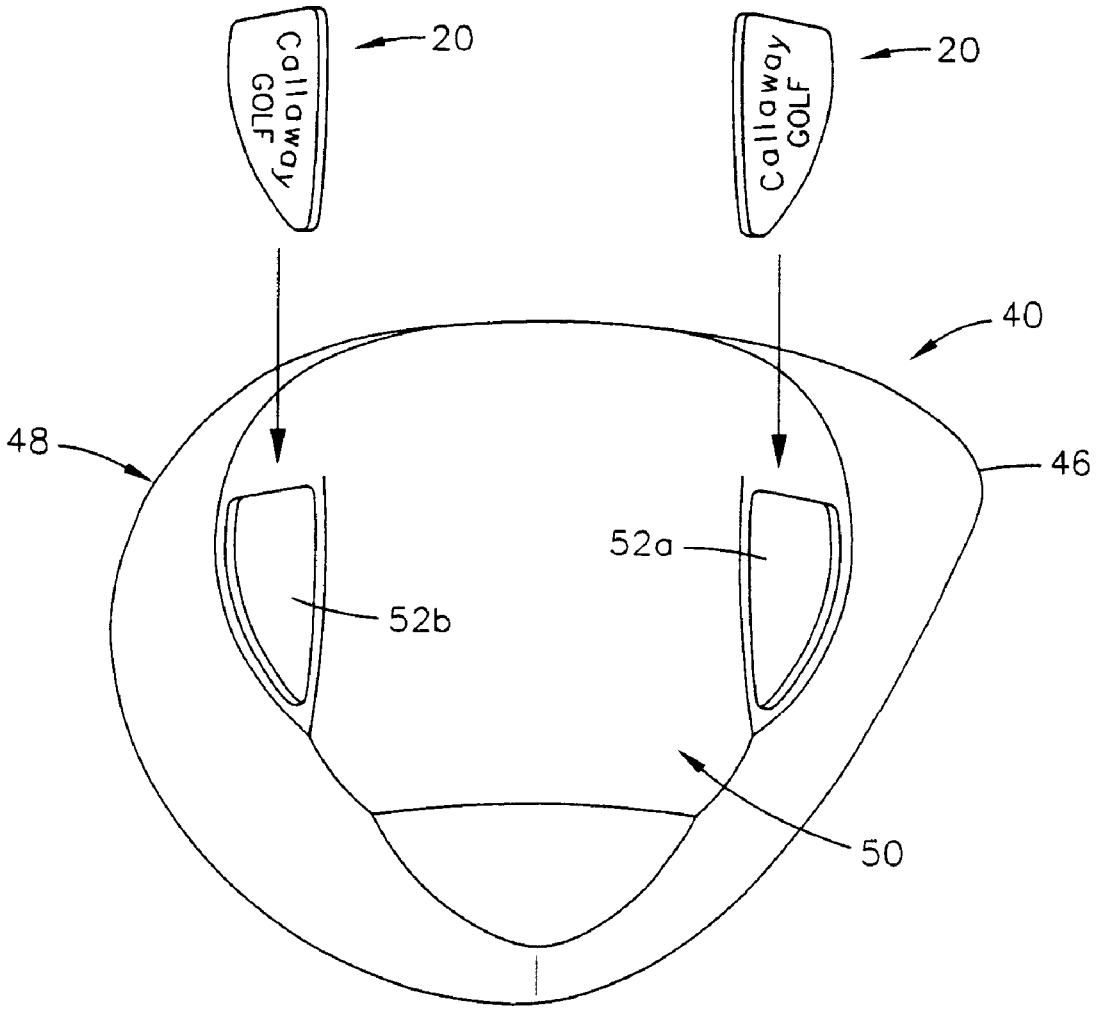
FIG. 7 is a bottom exploded view of the wood golf club head of FIG. 5 and the weighting devices of the present invention.

FIGS. 5–7 illustrate a golf club head 40 configured to utilize the weight device 20 of the present invention. The golf club head 40 is a wood, having a striking plate 42, a crown 44, a heel end 46, a toe end 48 and a sole 50. The sole 50 has a plurality of indentations 52*a* and 52*b* for placement of the weight devices 20 therein. Preferably, the indentations 52*a* and 52*b* have a depth that matches the thickness of the body 22 of the weight devices 20, and each has a shape that matches that of each body 22. The weight devices 20 may be mechanically fixed through compaction in each of the indentations 52*a* and 52*b,* or chemically adhered to the indentations with an adhesive such as epoxy. However, the attachment mechanism should allow for removal of the weight device 20 from the indentations 52*a* and 52*b*. In compaction, the weight devices 20 may be pried from the indentations 52 and 52*b,* while using an adhesive may require reheating for removal purposes.

Figure 8:
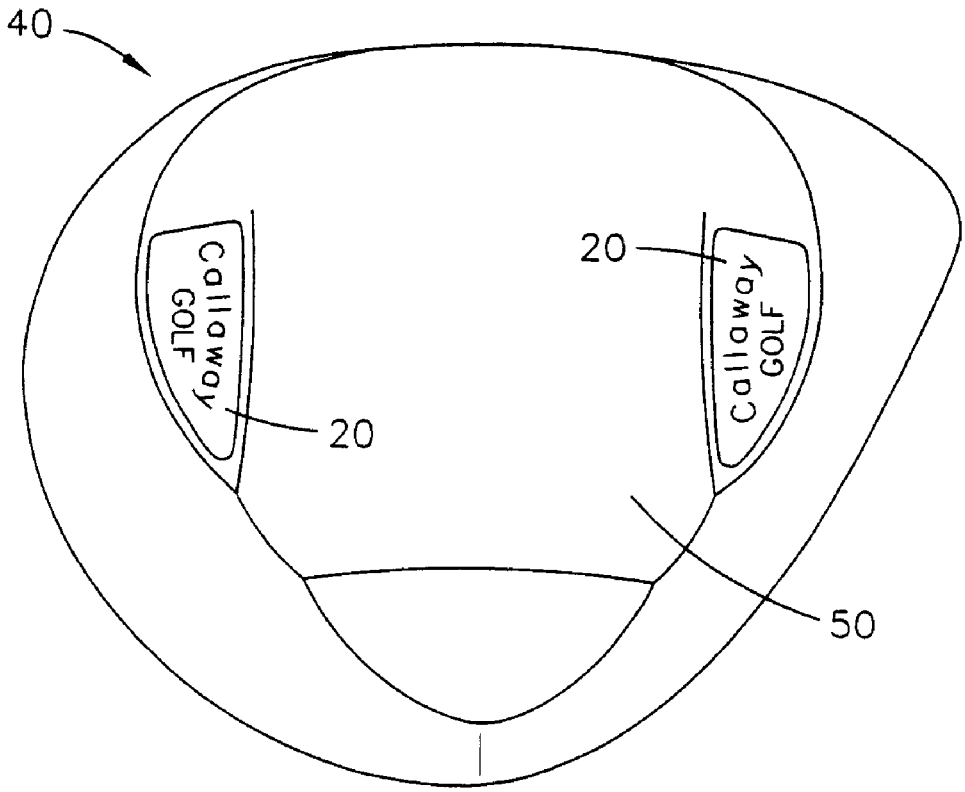
FIG. 8 is a bottom view of the wood golf club head of FIG. 5 and the weighting devices of the present invention.
Figure 9:
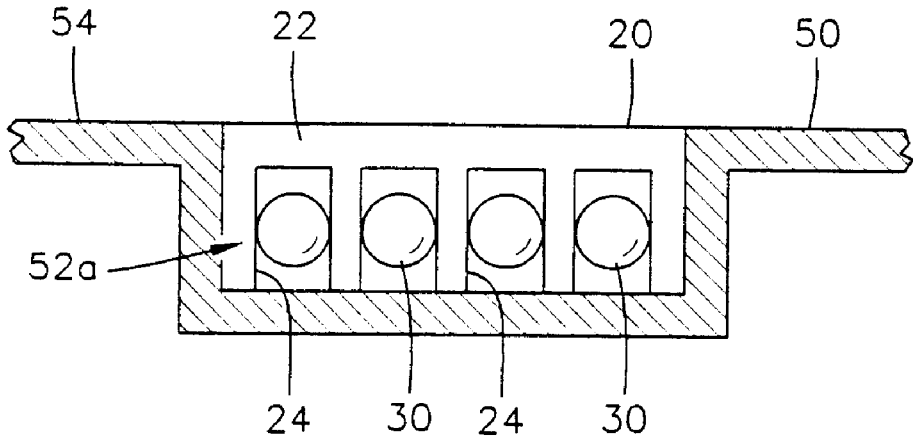
FIG. 9 is a cross-sectional view of the weighting device of the present invention within the golf club head of FIG. 5.

FIGS. 8 and 9 illustrate the weight devices 20 attached to the sole. FIG. 9 shows a cross-section of the placement of the weight device 20 within the indentation 52*a*. The exterior surface 28 of the weight device 20 is planar with the shell 54 of the sole 50 so that the weight device does not affect the movement of the sole 50 over grass during a swing. Those skilled in the pertinent art will recognize that the weight device 20 may be positioned within a hollow interior of a wood golf club head 42 without departing from the scope and spirit of the present invention.

Figure 10:
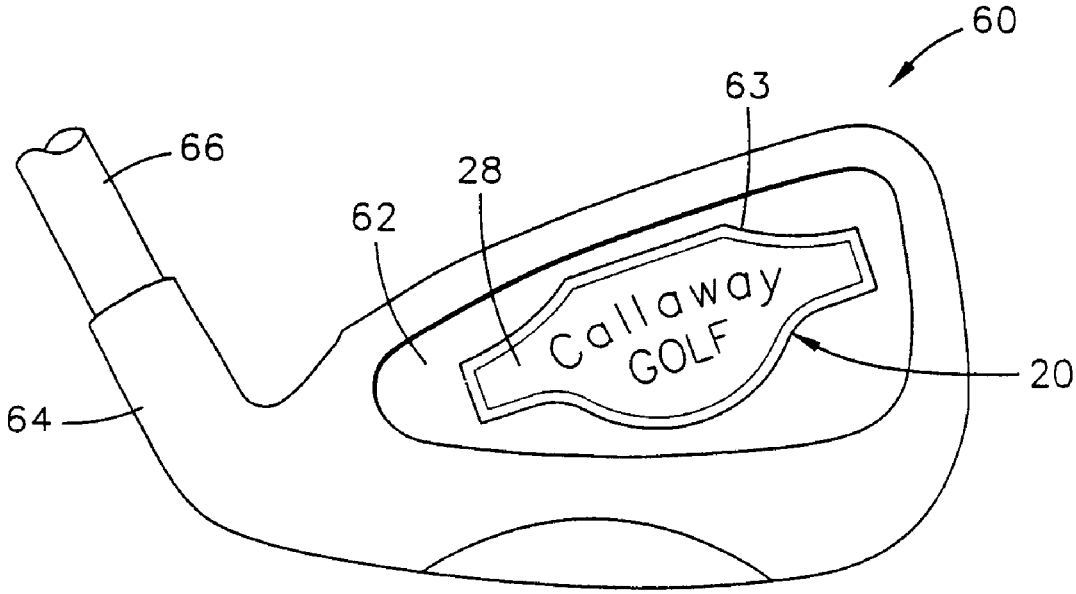
FIG. 10 is a rear view of an iron golf club head with a weighting device of the present invention.
Figure 11:
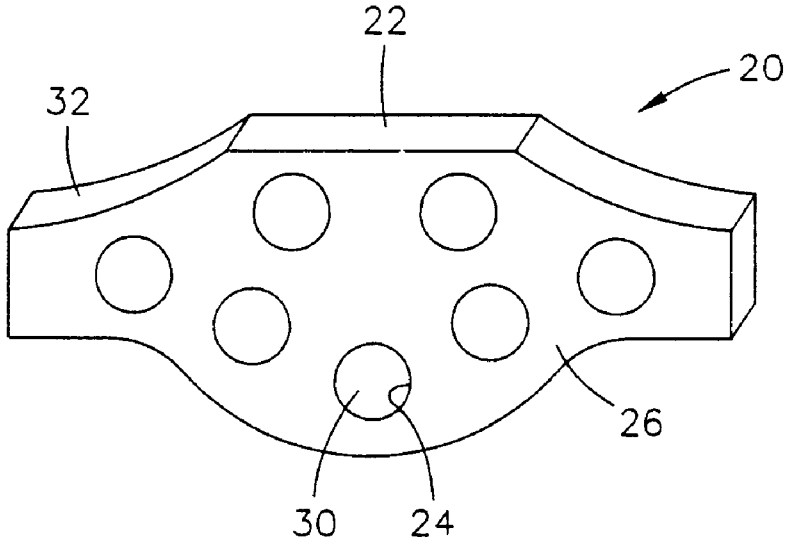
FIG. 11 is an isolated view of the weighting device of FIG. 10.

FIGS. 10 and 11 illustrates a variation of the weight device 20 for an iron golf club head 60. The weighting device 20 is positioned on a rear cavity 62 within a pocket 63. Attachment is similar to that described for the woods. The iron 60 has a hosel 64 with a shaft 66 inserted therethrough. The weighting device 20 has a medallion shape body 22 with a thickness defined by the perimeter wall 32. The high density members 30 are positioned within the ports 24 on the interior surface 26 of the body 22. The exterior surface 28 may have an indicia 34 thereon. Those skilled in the art will recognize that the weight device 20 may be used on a putter in a similar manner.

From the foregoing it is believed that those skilled in the pertinent art will recognize the meritorious advancement of this invention and will readily understand that while the present As invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A wood-type golf club head having a weighting device comprising:

a striking plate, a crown, a toe end, a heel end, and a sole;

the sole having a plurality of indentations wherein a plurality of weighting devices are placed;

each of the plurality of weighting devices having a polyurethane body composed of a first material having a density in the range of 0.90 grams per cubic centimeter to 1.00 grams per cubic centimeter, each body having a plurality of ports; and a plurality of high density members, each of the plurality of high density members having a density of at least 5 grams per cubic centimeter and being disposed within a corresponding port of the plurality of ports.

2. The weighting device according to claim 1 wherein each of the high density member is composed of tungsten.

3. The weighting device according to claim 1 wherein the weighting device is at least 10% of the weight of the golf club head.

4. The weighting device according to claim 1 wherein the body has a volume of 10 cubic centimeters and the plurality of ports occupy between 5 grams per cubic centimeter and 10 grams per cubic centimeter of that volume.

5. The weighting device according to claim 1 wherein 0–50% of the plurality of the ports are occupied by a high density member of the plurality of high density members.

6. The golf club head according to claim 1 further comprising a hollow interior wherein at least one weighting device is disposed within the hollow interior.

7. The golf club head according to claim 1 wherein the golf club head is composed of titanium.

8. An iron-type golf club head having a weighting device comprising:

a body composed of a metal material and having a striking plate, a sole, a toe end, a heel end, and a back surface with a recessed cavity;

a weighting device being disposed in the recessed cavity, the weighting device comprising a polyurethane body composed of a first material having a density in the range of 0.90 grams per cubic centimeter to 1.00 grams per cubic centimeter, the body having a plurality of ports; and a plurality of high density members, each of the plurality of high density members having a density of at least 5 grams per cubic centimeter and being disposed within a corresponding port of the plurality of ports.

9. The golf club bead according to claim 8 wherein the weighting device is at least 10% of the weight of the golf club head.

* * * * *